US006418861B1

(12) United States Patent
Flam

(10) Patent No.: US 6,418,861 B1
(45) Date of Patent: Jul. 16, 2002

(54) MODULAR PALLET CONSTRUCTION

(75) Inventor: Steve A. Flam, Farmington Hills, MI (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/713,758

(22) Filed: Nov. 15, 2000

Related U.S. Application Data

(60) Provisional application No. 60/166,256, filed on Nov. 18, 1999.

(51) Int. Cl.[7] ..... B65D 19/00

(52) U.S. Cl. ..... 108/56.1; 108/57.33; 108/57.21; 108/901

(58) Field of Search ..... 108/51.11, 56.1, 108/56.3, 57.21, 57.23, 57.25, 57.33, 57.34, 901; 248/346.02

(56) References Cited

U.S. PATENT DOCUMENTS

| | | | | | |
|---|---|---|---|---|---|
| 923,975 | A | * | 6/1909 | Johnston | |
| 1,993,237 | A | * | 3/1935 | Barrett | 108/57.23 |
| 2,152,086 | A | | 3/1939 | Powell | |
| 2,371,106 | A | | 3/1945 | Lewis et al. | |
| 2,491,073 | A | | 12/1949 | Barrett | |
| 2,705,120 | A | | 3/1955 | Owen | |
| 2,817,485 | A | | 12/1957 | White et al. | |
| 2,918,241 | A | | 12/1959 | Maher | |
| 2,933,339 | A | | 4/1960 | Alvden | |
| 3,308,772 | A | | 3/1967 | Thomas, Jr. | |
| 3,469,542 | A | | 9/1969 | Ahlenius | |
| 3,511,191 | A | | 5/1970 | Barry, Jr. et al. | |
| 3,531,855 | A | * | 10/1970 | Spring, Jr. | 108/57.23 X |
| 3,581,681 | A | | 6/1971 | Newton | |
| 3,592,145 | A | * | 7/1971 | Petry | 108/57.21 |
| 3,602,157 | A | | 8/1971 | Cohen | |
| 3,650,224 | A | | 3/1972 | Petix et al. | |
| 3,654,877 | A | | 4/1972 | Barrett | |
| 3,675,596 | A | | 7/1972 | Colas | |
| 3,680,496 | A | | 8/1972 | Westlake | |
| 3,685,461 | A | | 8/1972 | Belcher | |
| 3,719,157 | A | | 3/1973 | Arcocha et al. | |
| 3,720,176 | A | | 3/1973 | Munroe | |
| 3,726,236 | A | | 4/1973 | Colas | |
| 3,878,976 | A | | 4/1975 | Morrison | |
| 4,497,260 | A | | 2/1985 | Bucher | |
| 4,694,962 | A | | 9/1987 | Taub | |
| 4,895,080 | A | | 1/1990 | Thomas | |
| 4,931,340 | A | | 6/1990 | Baba et al. | |
| 4,940,380 | A | | 7/1990 | Ballyns et al. | |
| 5,007,352 | A | * | 4/1991 | Calkoen | 108/56.1 |
| 5,046,021 | A | | 9/1991 | Salvagnini | |
| 5,056,666 | A | | 10/1991 | Janssens | |
| 5,067,418 | A | | 11/1991 | Carter | |
| 5,094,175 | A | | 3/1992 | Christie | |
| 5,105,746 | A | * | 4/1992 | Reynolds | 108/56.1 |
| 5,225,613 | A | | 7/1993 | Shuert | |

(List continued on next page.)

FOREIGN PATENT DOCUMENTS

| | | | | |
|---|---|---|---|---|
| FR | 1301889 | * | 7/1962 | 108/56.1 |

*Primary Examiner*—Janet M. Wilkens
(74) *Attorney, Agent, or Firm*—Edgar A. Zarins; Lloyd D. Doigan

(57) ABSTRACT

A modular pallet construction allowing the formation of storage pallets of varying sizes and configurations. The pallet includes a top deck formed from a plurality of plate members interconnected to create a storage platform. The number and orientation of the plate members dictates the configuration of the top deck. The top deck is supported by beams which create a space beneath the top deck into which lift forks may be inserted to transport the pallet and its contents. In order to reduce the weight of the pallet yet provide ample strength, the plate members are formed with a core of high density expanded foam encapsulated in a rigid coating material.

12 Claims, 4 Drawing Sheets

U.S. PATENT DOCUMENTS

| | | | |
|---|---|---|---|
| 5,226,373 | A | 7/1993 | Esch |
| 5,236,099 | A | 8/1993 | Fties et al. |
| 5,251,832 | A | 10/1993 | Hentschel |
| 5,337,681 | A | 8/1994 | Schrage |
| 5,401,347 | A | 3/1995 | Shuert |
| 5,417,167 | A | 5/1995 | Sadr |
| 5,440,998 | A | 8/1995 | Morgan, IV et al. |
| 5,470,641 | A | 11/1995 | Shuert |
| 5,483,899 | A | 1/1996 | Christie |
| 5,582,113 | A | 12/1996 | Langenbeck |
| 5,887,529 | A | 3/1999 | John et al. |
| 5,941,179 | A | 8/1999 | Herring |
| 5,967,056 | A | 10/1999 | Plante |

* cited by examiner

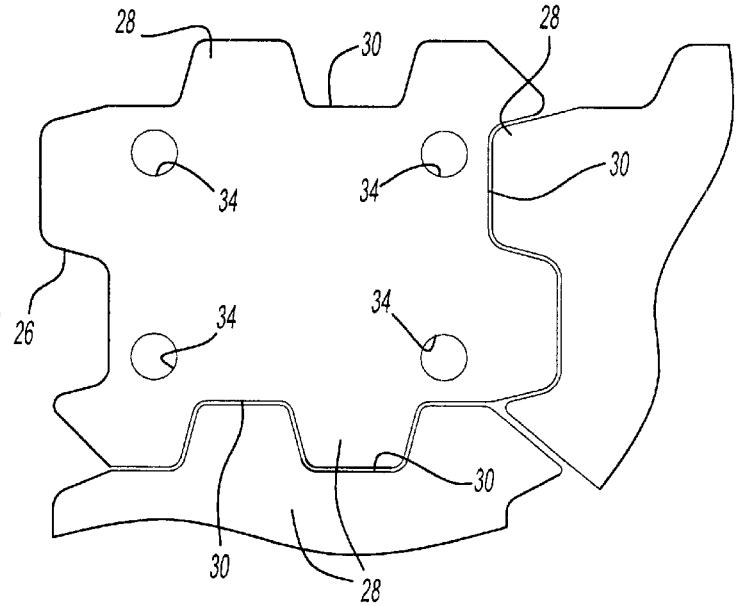
Fig-3A
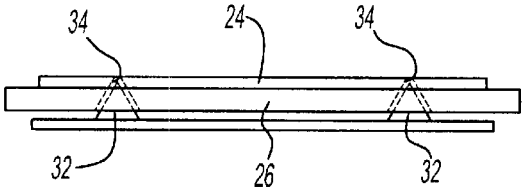
Fig-3B
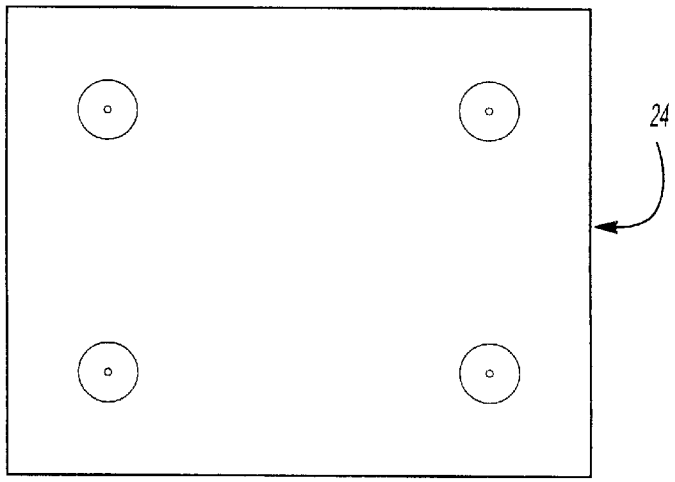
Fig-4A
Fig-4B
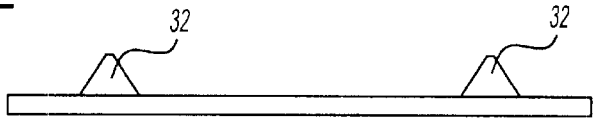

MODULAR PALLET CONSTRUCTION

RELATED APPLICATIONS

This application claims priority from U.S. Provisional Application No. 60/166,256 filed Nov. 18, 1999.

BACKGROUND OF THE INVENTION

I. Field of the Invention

This invention is related to modular pallet constructions and, in particular, to a lightweight modular pallet which facilitates the construction of pallets of various sizes and configurations with sufficient strength to support typical loads.

II. Description of the Prior Art

Traditionally, storage pallets have been constructed of wood materials in conventional configurations. In the past, wood has been a relatively inexpensive and simple to work with material. As lumber prices have increased along with concern with depletion of our natural resources, alternative materials have been explored. Additionally, the exportation of goods on wood pallets is prohibited between some countries because of the concern of introducing pests such as wood beetles. Therefore, manmade materials must be utilized as storage platforms.

It has also become desirable to construct pallets of different dimensions to more closely accommodate the size of different loads and thereby reduce storage costs by standing the loads side-by-side. Although wood pallets can be constructed of different dimensions, the pallets are not easily rearranged for different loads. Because wood pallets tend to be viewed as disposable, pallets constructed of manmade materials will be more readily accepted as returnable and reusable.

SUMMARY OF THE PRESENT INVENTION

The present invention overcomes the disadvantages of the prior known pallets by providing an entirely modular construction which facilitates the assembly of pallets of nearly any size and configuration.

The modular pallet of the present invention includes a top deck formed of a plurality of interlocking plates which are combined to create the desired dimensional attributes of the pallet. The plates may be combined in various orientations to create the required storage deck for the pallet. Each of the plates is preferably constructed of a base and a cap plate secured together for improved strength. In order to provide a space for insertion of lift forks, the connected top deck is mounted to at least one intermediate I-beam and end box beams for supporting the edges of the deck. In a preferred embodiment, the I-beam and end beams include slots for receiving the edges of certain plates forming the top deck. One or more bottom slats may be used to connect the bottom edges of the beams.

The components of the modular pallet may be formed of a variety of man-made materials including being molded or extruded of plastic or composite wood/plastic. One preferred embodiment of the invention contemplates manufacturing the components using a foam core material coated or encapsulated in a more dense and rigid material. Such a construction would substantially reduce the weight of the assembled pallet while maintaining transport strength. Possible materials for the core material include polystyrene foam of a high density. Coating materials may include a polyurea coating. The individual components of the pallet may be molded then coated with the rigid material or the entire assembled pallet may be coated with the rigid material. Although coating the entire assembly would reduce the cost of manufacture it reduces the flexibility to rearrange different sized pallets.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 3 is an enlarged partial top view of the top storage deck of the present invention;

FIG. 4 is an enlarged view of the cap piece for the deck plates;

DETAILED DESCRIPTION OF A PREFERRED EMBODIMENT OF THE PRESENT INVENTION

Figure 1:
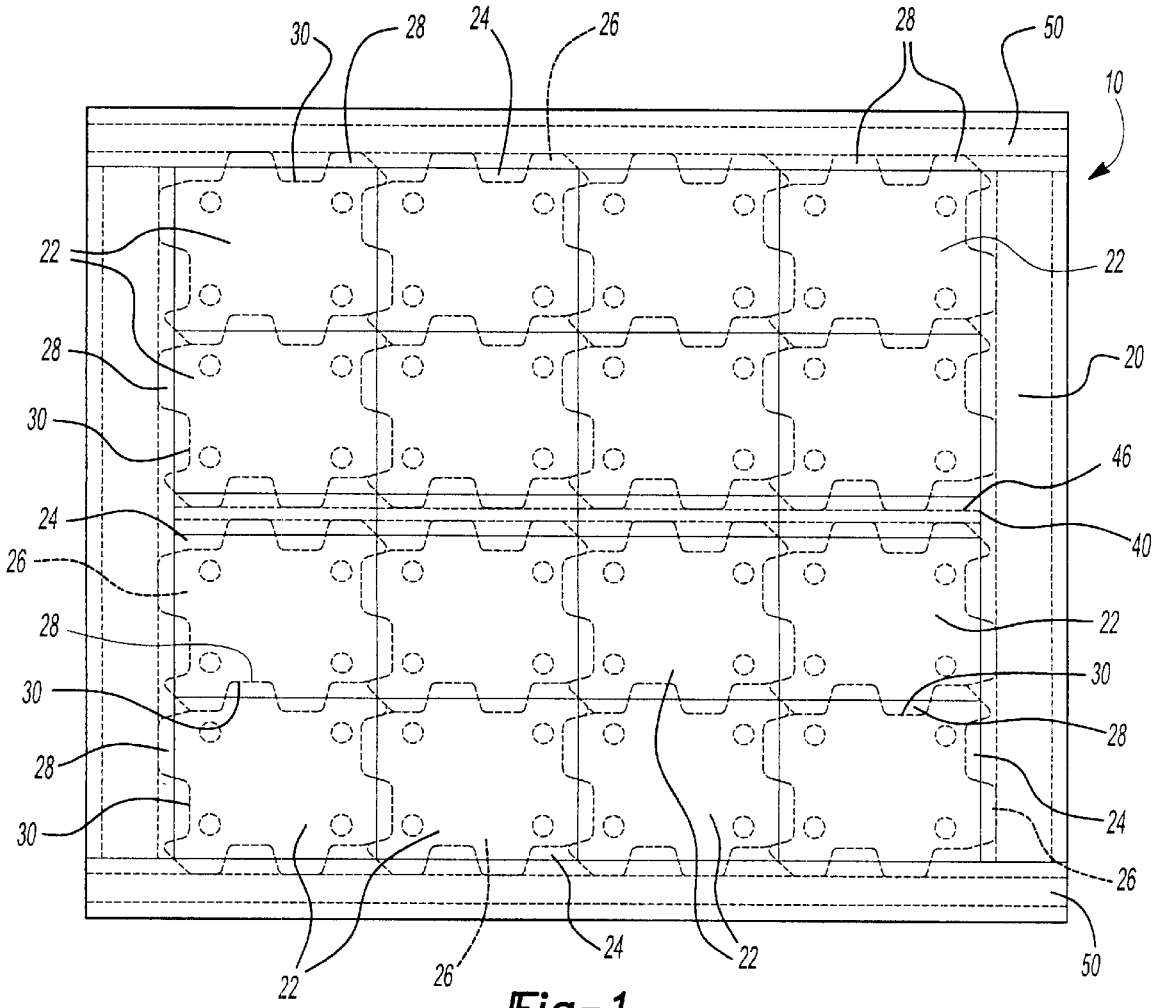
FIG. 1 is a top view of a first embodiment of a modular pallet construction embodying the present invention.
Figure 2:
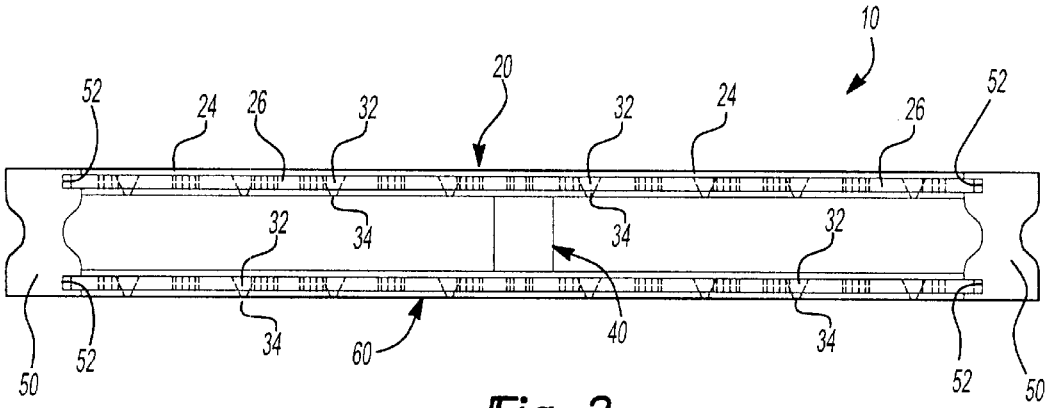
FIG. 2 is an end view of the modular pallet.
Figure 5:
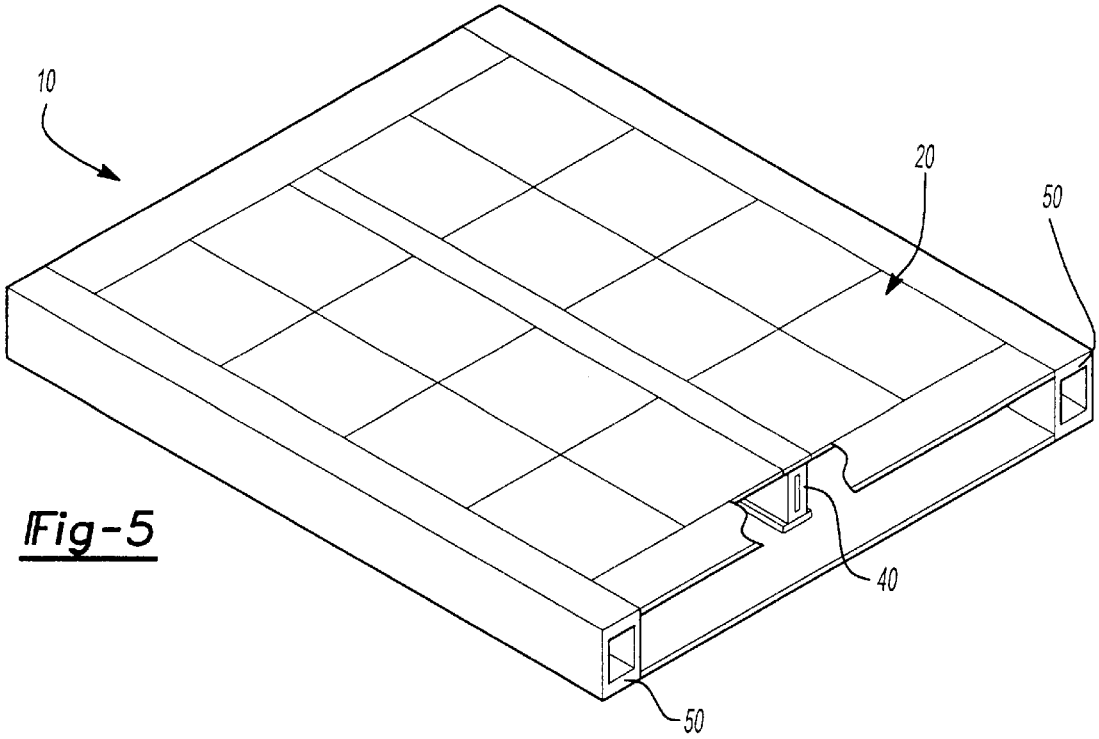
FIG. 5 is a perspective view of a modular pallet embodying present invention.
Figure 6A:
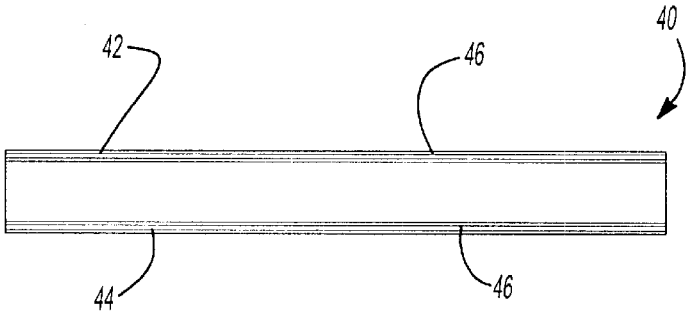
FIG. 6 is a diagram of the intermediate I-beam.
Figure 6B:
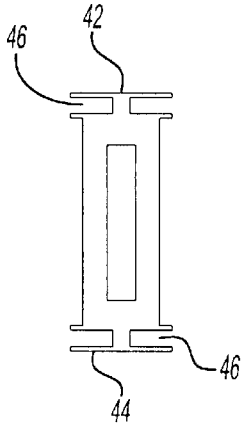
Figure 6C:
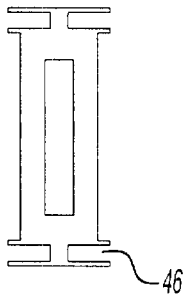
Figure 7A:
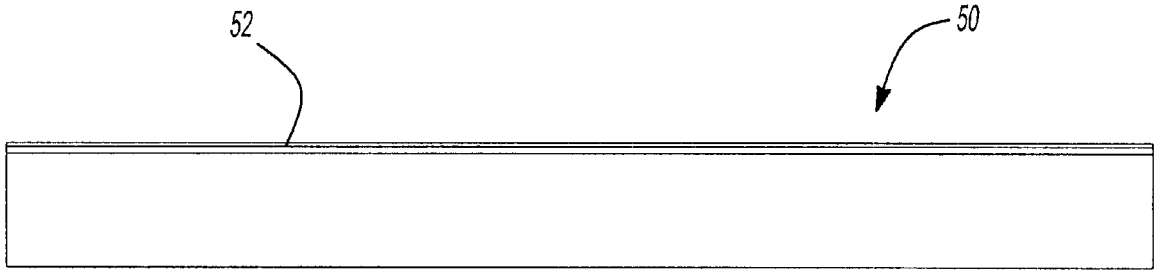
FIG. 7 is a diagram of the outer box beams.
Figure 7B:
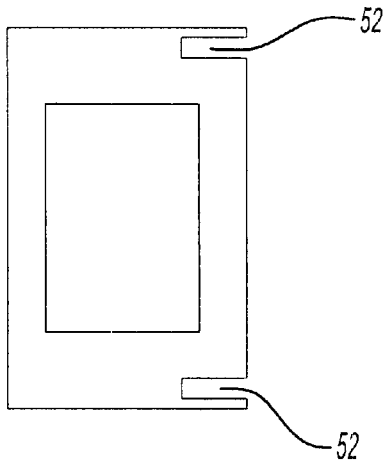

Referring to the drawing, there is shown a modular pallet 10 adapted for convenient storage and transport of inventory, supplies, machinery, etc. As with traditional pallets, the present invention facilitates engagement and transport by lift forks and stacking in storage areas. However, the modular construction of the pallet 10 allows convenient assembly of storage pallets of nearly any workable configuration.

Generally, the modular pallet 10 of the present invention includes a top deck 20 to support the load, at least one intermediate beam 40 and end beam 50. A bottom deck 60 may be provided to connect the bottom edges of the beams 40 and 50.

The top deck is formed of a plurality of interconnected plates 22 which are combined to form a deck 20 of the desired configuration and dimensions. Any number of plates 22 may be combined along the width and length of the pallet 10. The plates 22 each include an upper plate 24 secured to a lower plate 26. The combined plate 22 has a plurality of tabs 28 and grooves 30 spaced around the periphery of the plate 22. These tabs 28 and grooves 30 cooperate with corresponding tabs and grooves of adjacent plates 22 to form the top deck 20. These plates 22 fit together much in the same manner as a puzzle piece to form the deck 20.

The at least one intermediate beam 40 provides support of the deck 20 along an intermediate portion thereof. The beam 40 preferably has an I-beam configuration extruded from a plastic material. Formed along the top edge 42 and the lower edge 44 are slots 46 for receiving an edge of the plates 22 to provide support for the top deck 20.

The end beams 50 similarly provide support to the top deck 20 along the outer edges of the deck 20. The end beams 50 may include slots 52 for receiving the plates 22 to interconnect the beams 50 with the top deck 20.

The components of the pallet construction 10 may be assembled in a variety of orientations to construct a pallet 10 of nearly any desired configuration. The flexibility of configuration stems from the assembly of the individual plates 22. Each of the plates 22 is a sandwich assembly of a substantially rectangular upper plate or cap 24 secured to the puzzle-like lower plate or base 26. In a preferred embodiment, the upper plate 24 includes a plurality of cones 32 which are received in corresponding apertures 34 of the lower plate 26 to join the plates 22. Upon joining a plurality of plates 22, the upper plate 24 will be contiguous to form a complete planar surface upon which the load will be stored and the configured lower plate 26 contribute the tabs 28 and notches 30 for connecting adjacent plates 22. The tabs 28 will also be received in the slots of the intermediate beam 40 and the peripheral beams 50 to connect the top deck 20 to the frame. In at least one embodiment, the pallet construction 10 will include both a top deck 20 and a similarly configured bottom deck 60.

In order to reduce the overall weight of the pallet, 10, the individual components are molded from manmade materials. A preferred embodiment of the present invention contemplates molding the plates 24,26 of a structural foam and encapsulating the plates 24,26 in a more rigid material. The base material could be a high density, polystyrene foam with a polyurea coating. The beams 40,50 are molded or extruded of plastic or a composite of wood and plastic. As an alternative, the plates 22 molded of the structural foam could be assembled to form the top deck and then encapsulated to create a substantially integral deck 20.

The foregoing detailed description has been given for clearness of understanding only and no unnecessary limitations should be understood therefrom as some modifications will be obvious to those skilled in the art without departing from the scope and spirit of the appended claims.

What is claimed is:

1. A modular pallet construction comprising:

a top deck formed of a plurality of interconnected plate members, said plate members including a lower plate attached to an upper plate, said upper plate having a substantially rectangular configuration and said lower plate having notches and tabs formed on the periphery thereof wherein said lower plate interconnects said plate members to form said top deck and said upper plate cooperates with adjacent upper plates to form a load bearing surface; and at least one cross support member forming a passageway beneath said top deck, said at least one cross support member having longitudinal slots on opposing sides for receiving said tabs of said plate members to detachably connect said top deck to said at least one cross support member.

2. The modular pallet as defined in claim 1 wherein said at least one cross support member includes an intermediate beam having said longitudinal slot on opposing side thereof for connecting to said top deck and a pair of end beams having said longitudinal slot along one side for connecting to said top deck.

3. The modular pallet as defined in claim 2 and further comprising a pair of edge beams disposed perpendicular to said intermediate beam and end beams, said edge beams having said longitudinal slot along one side for connecting to said top deck, said edge beams and end beams framing said top deck.

4. The modular pallet as defined in claim 2 and further comprising a bottom deck formed of a plurality of said interconnected plate members, said plate members of said bottom deck connected to said at least one cross support member.

5. The modular pallet as defined in claim 2 wherein said upper and lower plates each include a core of high density foam encapsulated with a rigid coating material.

6. The modular pallet as defined in claim 5 wherein said core of high density foam of said upper and lower plates are assembled prior to encapsulating said plate member with said rigid coating material.

7. The modular pallet as defined in claim 5 wherein said core of high density foam of said upper and lower plates are assembled to form said plate members and said plate members interconnected to configure said top deck prior to encapsulating said top deck with said rigid coating material.

8. The modular pallet as defined in claim 5 wherein said at least one cross support member is extruded from a plastic material.

9. A modular pallet construction comprising:

a top deck formed of a plurality of interconnected plate members, said plate members including a lower plate attached to an upper plate, said upper plate having a substantially rectangular configuration and said lower plate having notches and tabs formed on the periphery thereof and configure to interlock with corresponding tabs and notches of an adjacent plate member whereby said lower plate interconnects said plate members and said upper plate cooperates with adjacent upper plates to form a load bearing surface;

an intermediate cross support member having longitudinal slots on opposing sides for receiving said tabs of said plate members to connect said top deck to said intermediate cross support member; and end support members having a longitudinal slot along one edge for receiving said tabs of said plate members to connect said top deck to said end support members.

10. The modular pallet as defined in claim 9 and further comprising a bottom deck connected to said support members and spaced apart from said top deck, said bottom deck formed of a plurality of said interconnected plate members.

11. The modular pallet as defined in claim 9 wherein said upper and lower plates each include a core of high density foam encapsulated with a rigid coating material.

12. The modular pallet as defined in claim 9 wherein said at least one cross support member is extruded from a plastic material.

* * * * *